United States Patent [19]

Kunz

[11] Patent Number: 4,809,011

[45] Date of Patent: Feb. 28, 1989

[54] ELECTRONICALLY STEERABLE ANTENNA APPARATUS

[75] Inventor: Kaiser S. Kunz, Las Cruces, N. Mex.

[73] Assignee: Kunz Associates, Inc., Albuquerque, N. Mex.

[21] Appl. No.: 744,755

[22] Filed: Jun. 14, 1985

[51] Int. Cl.[4] ..... H01Q 19/06

[52] U.S. Cl. ..... 343/754; 343/787; 343/909

[58] Field of Search ..... 343/753, 754, 787, 909

[56] References Cited

U.S. PATENT DOCUMENTS

| | | | |
|---|---|---|---|
| 2,939,142 | 5/1960 | Fernsler | 343/754 |
| 2,959,783 | 11/1960 | Iams | 343/909 |
| 3,255,451 | 6/1966 | Wolcott | 343/754 |
| 3,369,242 | 2/1968 | Johnson | 343/754 |
| 3,404,401 | 10/1968 | Arditi | 343/754 |
| 3,631,501 | 12/1971 | Buscher | 343/909 |
| 4,323,901 | 4/1982 | DeWames et al. | 343/909 |

*Primary Examiner*—Robert E. Wise

*Attorney, Agent, or Firm*—David B. Newman, Jr.

[57] ABSTRACT

An electronically steerable antenna which refracts an electromagnetic wave travelling through an electrooptic deflector, steers an electromagnetic wave to a desired angle. The electrooptic deflector includes first and second sections of electrooptical material. A voltage changes the indices of refraction of the electrooptical material, thereby causing a change in the angle of refraction at the interface between the first and second sections. Input and output impedance matching sections are provided effecting maximum power transfer of the electromagnetic wave travelling through the antenna.

22 Claims, 5 Drawing Sheets

ELECTRONICALLY STEERABLE ANTENNA APPARATUS

BACKGROUND OF THE INVENTION

This invention relates to guided electromagnetic wave transmission systems, and more particularly to electronically steerable antenna apparatus used in such systems.

DESCRIPTION OF THE PRIOR ART

In radar or radar-like applications, it is often desirable to steer the pointing direction of an antenna without mechanically moving the antenna. In the prior art, phase shifters find application, for example, in the control of the pointing of a phased array antenna. A phased array antenna comprises a number of individual radiating elements. The pointing direction of the array typically is determined by the relative phase of the electromagnetic energy coupled to each individual radiating element. Control of such phase can be performed with a ferrite phase shifter.

The pointing direction of the resultant antenna beam is dependent on the relative phase of energy coupled to the radiating elements. Command signals allow rapid change of the relative phase of energy coupled to the radiating elements driven by different phase shifters. The spatial distribution and phase control of the radiating elements may be arranged to permit scanning in a single angular direction (e.g. azimuth or elevation) or to permit simultaneous selection of the beam pointing direction in each of two angular directions (e.g. azimuth and elevation). In the case of scanning in two directions, it is generally necessary to set the phase angle uniquely at each radiating element in order to attain high performance levels over wide scan angles.

In the prior art, phased arrays typically attain high transmitter power by having a power amplifier device inserted between the phase shifter and antenna radiating element. This is due to the low power handling capability of phase shifters. Further, phased arrays typically have a limited bandwidth capability, in part, due to the limited bandwidth of phase shifters.

OBJECTS AND SUMMARY OF THE INVENTION

An object of the present invention is to provide an apparatus for steering an antenna beam without moving the antenna.

Another object of the present invention is to provide an apparatus having high power and broad bandwidth characteristics for steering an antenna beam.

A further object of the present invention is a simpler and more reliable electronically steerable antenna.

According to the present invention, as embodied and broadly described herein, an electronically steerable antenna is provided comprising input matching means, electrooptic means coupled to the input matching means and output matching means coupled to the electrooptic means. The input matching means, electrooptic means and output matching means may be embodied as an input matching section, an electrooptic deflector and an output matching section, respectively. In a first species of the subject invention, the electrooptic deflector includes first and second sections of electrooptical material, having first and second indices of refraction, respectively. A voltage is applied to either the first or second section. The first or second section are responsive to changes in the voltage by changing the index of refraction of the respective section, causing an electromagnetic wave travelling from the first section to the second section to be refracted. Input matching section includes at least one impedance matching portion for effecting maximum power transfer from the waveguide to the electrooptic deflector. Output matching section includes at least one impedance matching portion for effecting maximum power transfer from the electrooptic deflector to free space.

According to a second species of the present invention, an electronically steerable antenna is provided comprising an input matching section, an electrooptic deflector coupled to the input matching section, means coupled to the electrooptic deflector for amplifying the angle of refraction of the electromagnetic wave refracted by the electrooptic deflector and an output matching section coupled between the electrooptical deflector and the amplifying means. The electrooptic deflector includes first and second sections of electrooptical material, having first and second indices of refraction, respectively. A voltage is applied to either the first or second section. The first or second section are responsive to changes in the voltage by changing the index of refraction of the respective section, causing an electromagnetic wave travelling from the first section to the second section to be refracted. Input matching section includes at least one impedance matching portion for effecting maximum power transfer from the waveguide to the electrooptic deflector. The amplifying means includes electrooptical material having a varying index of refraction. Output matching section includes at least one impedance matching portion for effecting maximum power transfer from the amplifying means to free space.

Additional objects and advantages of the invention will be set forth in part in the description which follows, and in part will be obvious from the description, or may be learned by practice of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1A:
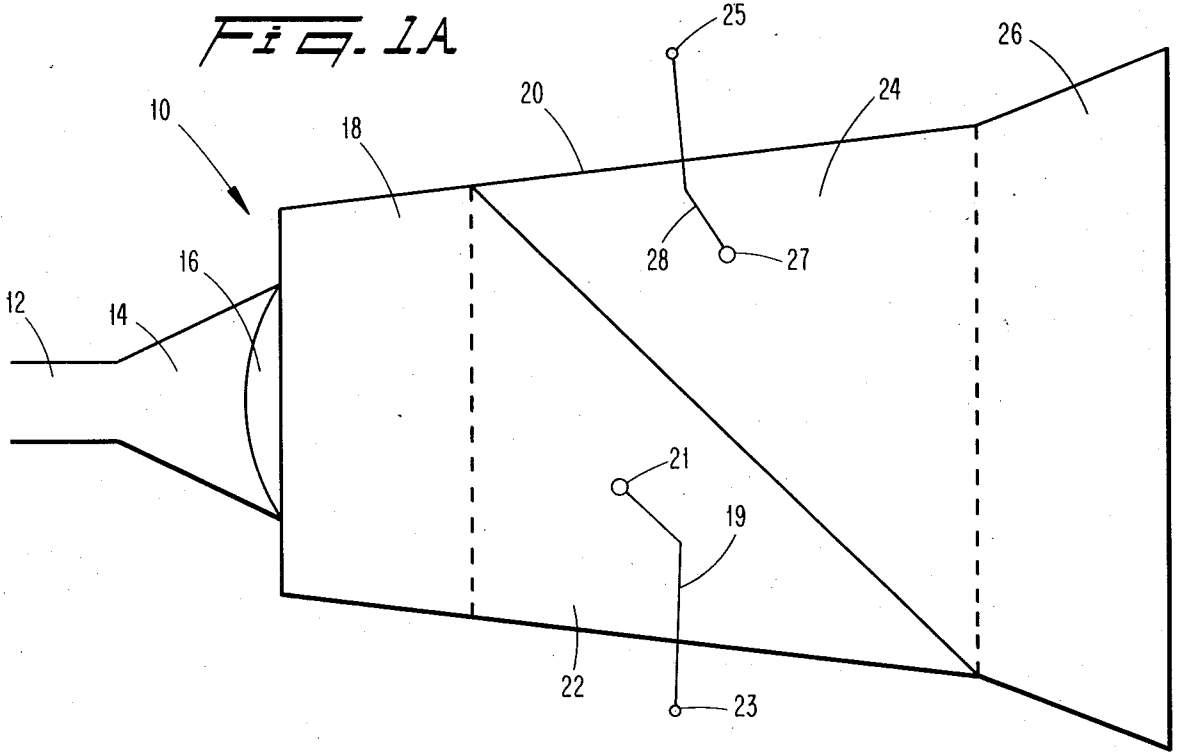
FIGS. 1A and 1B are top and side, respectively, block diagrammatic views of a first embodiment of an electronically steerable antenna according to the present invention.

Referring to FIG. 1A, a preferred embodiment of an electronically steerable antenna 10 is shown comprising input matching means, electrooptic means and output matching means. In the exemplary arrangement shown, the input matching means, electrooptic means and output matching means may be embodied, for example, as an input matching section 18, an electrooptic deflector 20 and an output matching section 26, respectively. The electrooptic deflector 20 is coupled to the input matching section 18 and the output matching section 26 is coupled to the electrooptic deflector 20. The electrooptic deflector 20 can include first and second sections 22, 24 of electrooptical material having first and second indices of refraction, respectively. The top surfaces of first and second sections 22, 24 each include a conductive coating. The conductive coating of first section 22 is electrically isolated from conductive coating of second section 24.

The electrooptic deflector 20 further includes means for applying a voltage to the first and second sections 22, 24. The means for applying a voltage may be embodied, for example, as a voltage source connected to first terminal 23 and parallel plate 6 in FIG. 1B. First terminal 23 is connected to the conductive coating of first section 22 through wire 19 and contact 21. Altenatively, the means for applying a voltage may be embodied, for example, as a voltage source connected to second terminal 25 and parallel plate 6 in FIG. 1B. Second terminal 25 is connected to the conductive coating of second section 24 through wire 28 and contact 27.

Input waveguide 12 is connected to input matching section 18 through a laterally flared horn 14 and a corrective lens 16. Input matching section 18 is connected to first and second sections 22, 24 of electrooptic deflector 20. Output matching section 26 is connected between electrooptic deflector 20 and free space. The laterally flared horn 14 and the corrective lens 16 collimate the electromagnetic wave travelling therein. Input matching section 18 serves to match impedance between input waveguide 12 and electrooptic deflector 20 and to also minimize reflections of electromagnetic waves incident to the electronically steerable antenna 10. Similarly, output matching section 26 serves to match impedance of electrooptic deflector 20 with free space and also to minimize reflections of electromagnetic waves leaving the electronically steerable antenna 10 into free space.

Figure 1B:
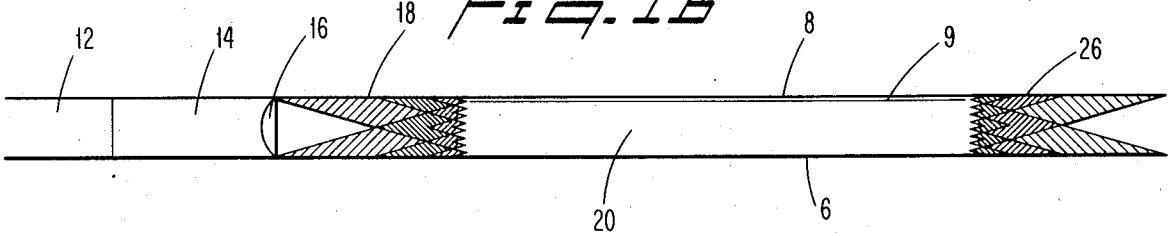

FIG. 1B illustrates a side view of the electronically steerable antenna 10. Input matching section 18 is further illustrated in FIG. 2. In FIG. 1B, first and second plates 8 and 6 form a parallel plate structure of the electronically steerable antenna 10. Electrooptic deflector 20 includes conductive coating 9 on the top surface of the electrooptical material. Conductive coating 9 located on first section 22 is electrically isolated from conductive coating 9 located on second section 24.

Input matching section 18, electrooptic deflector 20 and output matching section 26 are located between first and second parallel plates 8, 6. As an electromagnetic wave travels from the waveguide 12, the laterally flared horn 14, the corrective lens 16, the input matching section 18, the electrooptic deflector 20 and the output matching section 26, the electric field E of the electromagnetic wave is vertical and thus perpendicular to both plates 8 and 6.

Figure 2:
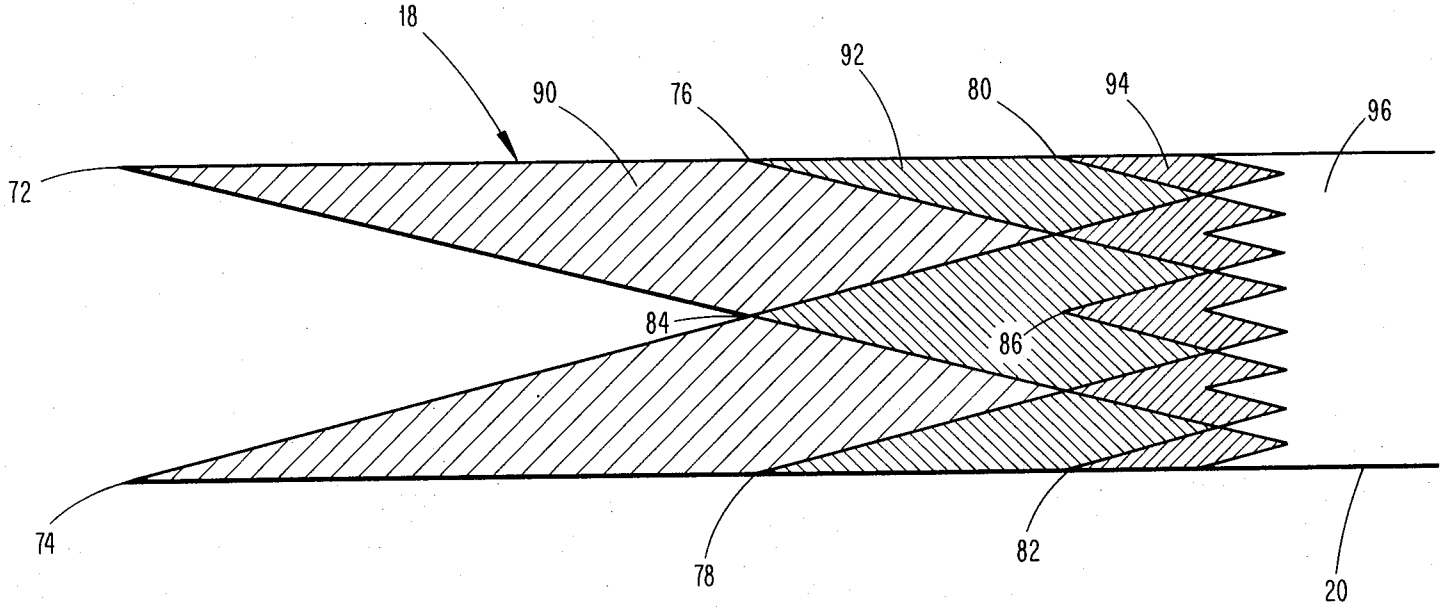
FIG. 2 is a block diagrammatic view of a matching section as used with the electronically steerable antenna according to the present invention.

An enlarged vertical cross section of input matching section 18 is depicted in FIG. 2. According to the present invention, the index of refraction of input matching section 18 does not vary in the transverse horizontal direction. Output matching section 26 is essentially the input matching section 18 as shown in FIG. 2, reversed from left to right.

The input matching section 18, as shown in FIG. 2, includes at least a first portion having corners at 72, 74, 76 and 78 representing a uniform transition at vertical plane 72, 74 from the air filled waveguide 12 with an index of refraction of one, to a completely filled waveguide of a first dielectric material 90 at vertical plane 76, 78 having an index of refraction, for example, of two. At the location of vertical plane 76, 78 in the waveguide, the wavelength of the electromagnetic wave is one half its free space value for the first dielectric material 90 having an index of refraction of two.

The input matching section 18, as illustratively shown, can further include third and fourth portions having corners 76, 84, 80 and 86, and 84, 86, 78 and 82, respectively. The third and fourth portions function as a uniform transition at vertical plane 76, 78 from the completely filled waveguide of first dielectric material 90 to the completely filled waveguide of a second dielectric material 92 at vertical plane 80, 82. With the second dielectric material 92 having an index of refraction of four, the wavelength of the electromagnetic wave is one quarter its free space value at the location of the vertical plane 80, 82 in the waveguide.

The input matching section 18 can include additional portions as necessary for matching the impedance of the waveguide 12 with the electrooptic deflector 20. Accordingly, fifth, sixth, seventh and eighth portions could be added of a third dielectric material 94 having an index of refraction of eight, for example. Then, as shown in FIG. 2, the electrooptic deflector 20 can have an electrooptic material 96 with an index of refraction of sixteen, and uniform transitions of third dielectric material 94 to the electrooptic material 96 in the electrooptic deflector would serve to match the impedances of the two materials.

The input matching section 18, which has the foregoing structure of portions with changing dielectric materials, has a changing index of refraction in the direction of a traveling electromagnetic wave. Accordingly, an electromagnetic wave travelling from left to right in the input matching section 18 of FIG. 2 encounters a waveguide filled with dielectric material having an increasing index of refraction. Similarly, since the output matching section 26 can be the same as the input matching section 18 but reversed, a travelling electromagnetic wave entering the output matching section will encounter a waveguide filled with dielectric material having a decreasing index of refraction.

The first and second sections 22, 24 in FIG. 1 include electrooptical material having first and second indices of refraction, respectively. An electromagnetic wave travelling from the first section 22 to the second section 24 is refracted when the first index of refraction is different from the second index of refraction. The amount of refraction of the electromagnetic wave is dependent upon the difference between the first and second indices of refraction. The first and second indices of refraction are dependent upon the electrooptical material used in the first and second sections and the voltage applied to each section. The electrooptical material used in each section can be identical; thus, the differences between the indices of refraction, therefore, would be dependent upon the voltage applied to each section.

The magnitude of the electrooptic effect, which is the change in an index of refraction by applying a voltage to the electrooptical material, is generally small in electrooptical materials used in the 1-100 GHz frequency range.

Electrooptical materials which can be used with the electrooptic deflector 20 include ceramic strontium titanate, $SrTiO_3$, and barium strontium titanate, $(Ba_xSr_{1-x})TiO_3$, where x is approximately 0.06. Strontium titanate has low loss and a relatively high electrooptic coefficient. Some improvement is achieved by mixing strontium titanate with barium titanate, $BaTiO_3$, forming barium strontium titanate.

The dielectric material used for the matching sections can be chosen from a broad range of materials because such materials need not have electrooptic properties. The main requirement for the material for the matching sections is that they have low loss. Also, a particular index of refraction can be achieved by mixing at least two dielectric materials having different indices of refraction. Examples of materials which can be used for matching sections include a mixture of polystrene and titanium dioxide, $TiO_2$, a mixture of kaolin and titanium dioxide, a mixture of zirconium dioxide, $ZrO_2$, and a mixture of titanium dioxide and barium magnesium tantalate, $Ba(Mg_{1/3}Ta_{2/3})O_3$.

Figure 3:
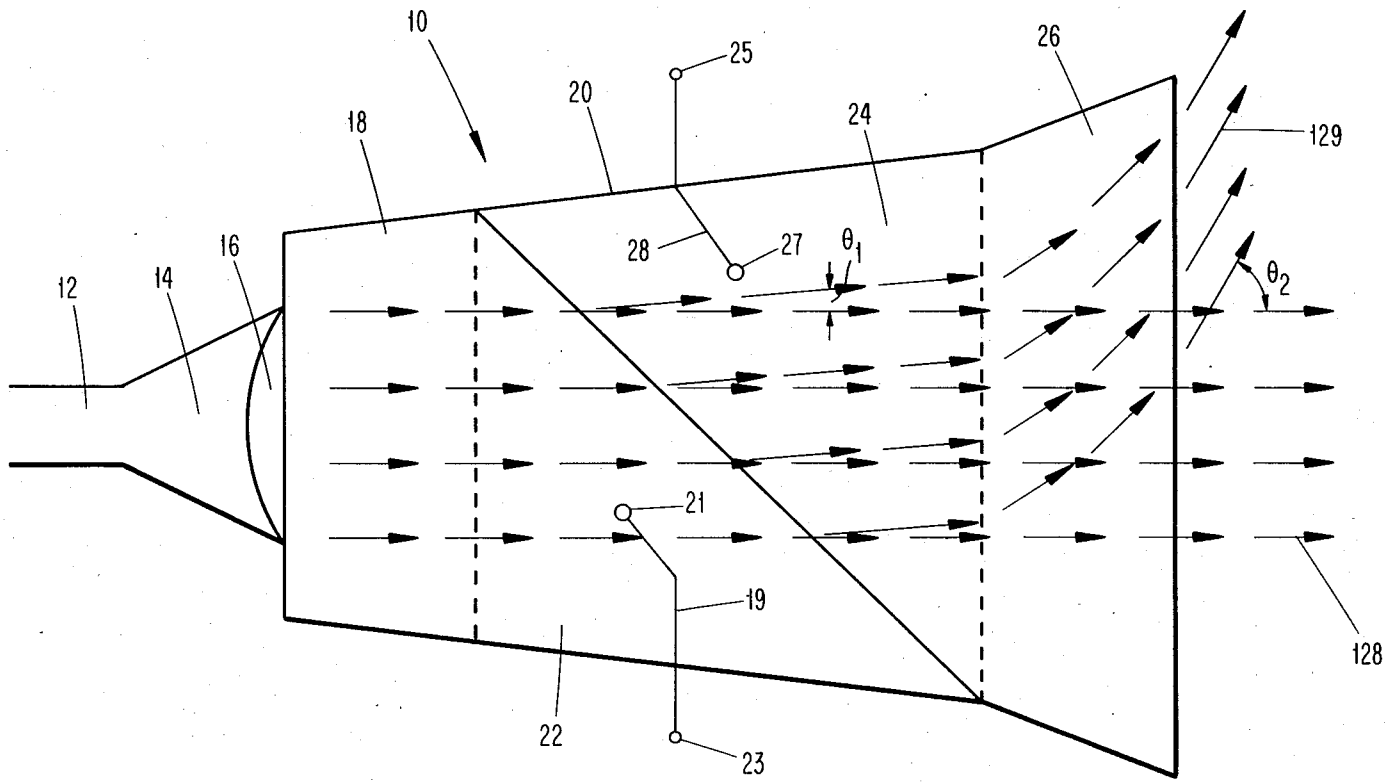
FIG. 3 is a block diagrammatic view of the first embodiment of the present invention illustrating ray paths of an electromagnetic wave.

Referring to FIG. 3, the electronically steerable antenna 10 is shown as in FIG. 1, and further with the Poynting vectors, depicted as arrows 128,129, of an electromagnetic wave travelling through the antenna. In operation an electromagnetic wave enters the electronically steerable antenna 10 from the waveguide 12. The electromagnetic wave is collimated as it travels through the laterally flared horn 14 and corrective lens 16. In a particular embodiment, the corrective lens may include an aperture lens. The corrective lens 16 produces a collimated diffraction limited electromagnetic wave, as indicated by the arrows 128. The electric field E of the collimated diffraction limited electromagnetic wave is perpendicular to both parallel plates 6, 8 of the electronically steerable antenna 10 in FIG. 1B.

The electromagnetic wave, as shown in FIG. 3, travels from the horizontally flared horn 14 and the corrective lens 16 into the input matching section 18. Input matching section 18 effects maximum power transfer and minimum reflections of the electromagnetic wave travelling from the horizontally flared horn 14 and corrective lens 16, to the electrooptic deflector 20. This is accomplished by having the input matching section provide a smooth transition from an index of refraction of one of the waveguide to the index of refraction $n_d$ of the electrooptical deflector 20.

From the input matching section 18 the electromagnetic wave travels into the electrooptical deflector 20. If no voltage is applied to either the first or second section 22, 24, then the refractive indices of each section are the same, assuming that each section consists of the same electrooptical material. Accordingly, the electromagnetic wave is not refracted at the interface between the first and second sections 22, 24, and travels straight through the electrooptic deflector 20 and output matching section 26, as indicated in FIG. 3 by arrows 128.

If a voltage is applied to either the first or second terminal 23, 25, then the index of refraction of the electrooptical material in the section to which the voltage is applied changes. In this case, the indices of refraction of the first and second sections 22, 24 are not equal. As a result, the electromagnetic wave travelling through the electrooptic deflector 20 is refracted at the interface between the first and second sections 22, 24, and travels the path of arrows 129, as shown in FIG. 3, for example.

At the interface between the first and second sections 22, 24 the electromagnetic wave refracts at an angle of deviation, $\theta_1$. The angle of deviation is relatively small. As the electromagnetic wave travels through the output matching section 26 to free space, however, the angle of deviation is amplified. Since the index of refraction of the output matching section 26 changes only in the longitudinal direction of the undeviated electromagnetic wave 128, the angle $\theta_2$ at which the electromagnetic wave leaves the electronically steerable antenna 10 in FIG. 3 is greatly amplified relative to the internal angle $\theta_1$. These angles are related by Snell's Law:

$$\sin \theta_2 = n_d \sin \theta_1$$

where $n_d$ is the index of refraction of the electrooptical deflector 20. Thus, for example, for $n_d = 25$, the electromagnetic wave will leave the antenna at an angle of 60° when $\theta_1$ is only 1.985°.

Electrooptic materials having a relatively low index of refraction, for example, between one and four, can also be used with the electrooptic deflector. Modification of the antenna is required, however.

Figure 4:
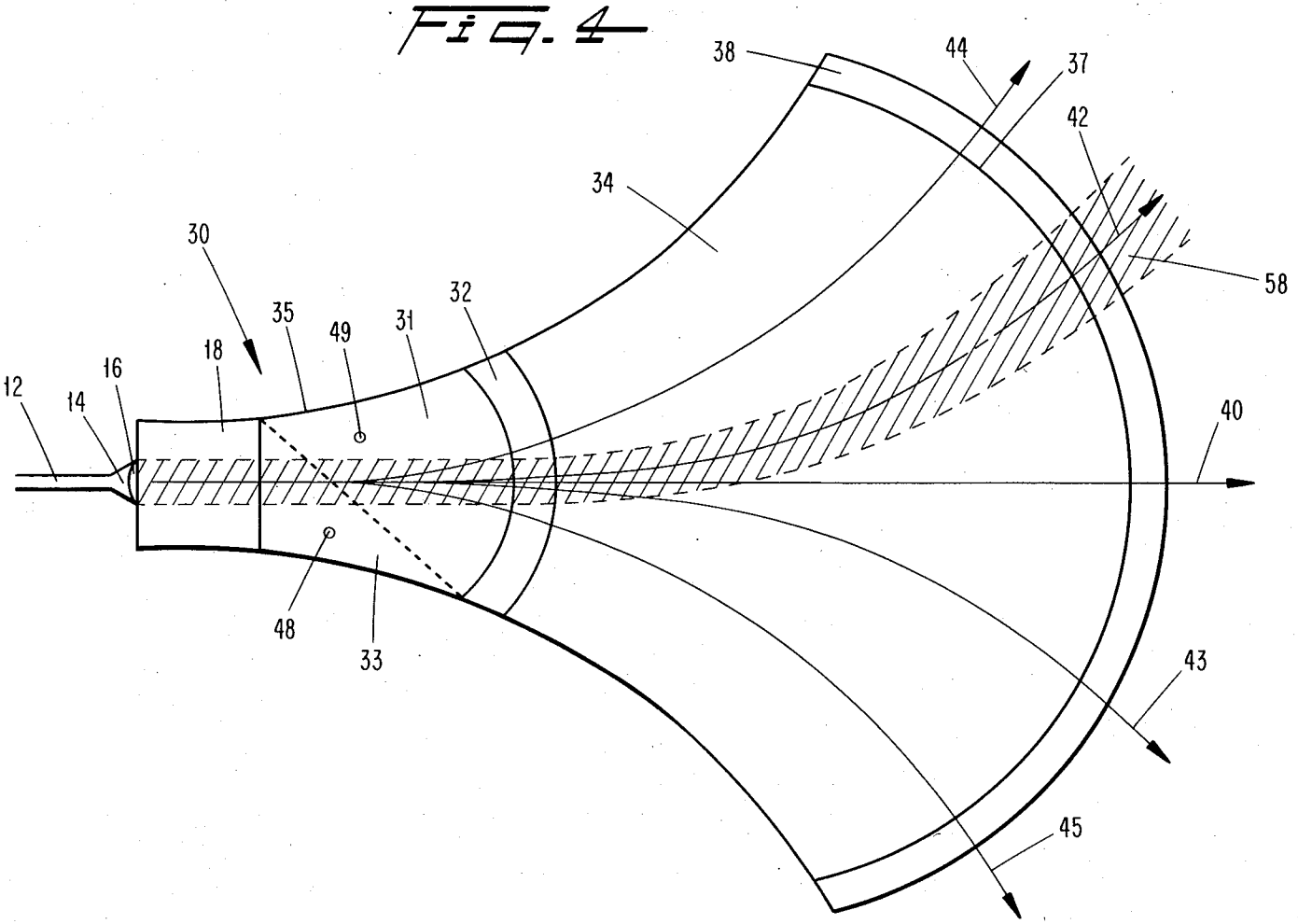
FIG. 4 is a block diagrammatic view of a second embodiment of an electronically steerable antenna according to the present invention.

FIG. 4 shows a preferred embodiment of the electronically steerable antenna 30 which includes an input waveguide 12, laterally flared horn 14, corrective lens 16, input matching section 18, electrooptic deflector 35, output matching section 32, angle amplifier 34 and terminator 38. Electrooptic deflector 35 includes third and fourth sections 33, 31. Laterally flared horn 14 and corrective lens 16 serve to collimate an electromagnetic wave inputted to the input matching section 18. Input matching section is identical in concept to that previously described with reference to FIG. 2. Accordingly, input matching section 18 effects maximum power transfer and minimum reflections of an electromagnetic wave travelling from laterally flared horn 14 and corrective lens 16 to electrooptic deflector 35. Input matching section 18 also serves to match impedance of input waveguide 12, laterally flared horn 14 and corrective lens 16 with electrooptic deflector 35. Electrooptic deflector 35 is essentially the same as electrooptic deflector 20 of FIG. 1, with the addition that electooptic deflector 35 has a curved shape at one end as shown, for example. Further, output matching section 32 has a curved shape, as shown in FIG. 4 for example, and otherwise is similar to output matching section 26 in FIG. 1. Angle amplifier 34 can have a flared circular shape, as shown in FIG. 4. Terminator 38 is essentially a curved matching section, similar to input and output matching sections 18, 26. Terminator 38 effects maximum power transfer from angle amplifier 34 to free space.

Angle amplifier 34 comprises two parallel plates having therein nonhomogeneous material, with an index of refraction varying continuously in a prescribed way. The varying index of refraction in angle amplifier 34 can cause an electromagnetic wave travelling through the angle amplifier 34 to increase its angle of deviation from that achieved by the electrooptic deflector 35. This increase in angle is in response to the electromagnetic wave being increasing deviated due to the index of refraction of material in amplifier 34 varying continuously in a mathematically determined way.

The rays of an electromagnetic wave travelling through angle amplifier 34 constitute a family of circles as indicated by ray paths 42–45. If $\Phi_1$ and $\Phi_2$ are the angles of a ray entering and exiting angle amplifier 34, respectively, then $\Phi_2 = m \cdot \Phi_1$, where m is the amplification factor of angle amplifier 34. For a particular angle amplifier, m is a constant.

Further, the rays leave angle amplifier 34 orthogonally to the out surface 37. Accordingly, electromagnetic waves are not refracted leaving angle 34.

The angle amplifier 34 allows construction of the electrooptic deflector 35 with materials having a relatively low index of refraction, for example, between one and four. Further, by using the electrooptic deflector 35 with a low index of refraction, fewer portions will be required in input and output matching sections 18, 32.

Referring to FIG. 4, the electronically steerable antenna 30 is shown further with possible central ray paths 42–45, of an electromagnetic wave travelling through the antenna. In operation an electromagnetic wave enters the electronically steerable antenna 30 from the waveguide 12. The electromagnetic wave is collimated as it travels through the laterally flared horn 14 and corrective lens 16.

The electromagnetic wave travels from the flared horn 14 and the corrective lens 16 into the input matching section 18. Input matching section effects maximum power transfer and minimum reflections of the electromagnetic wave travelling from flared horn 14 and corrective lens 16, to the electrooptic deflector 35.

Electrooptic deflector 35 includes third and fourth sections 33, 31 which operate in principle the same as first and second sections 22, 24. Thus, if no voltage is applied to either the third or fourth section 33, 31, then the refractive indices of each section are the same, assuming that each section consists of the same electrooptic material. Accordingly, the electromagnetic wave is not refracted at the interface between the third and fourth sections 33, 31, and travels straight through the electrooptical deflector 35, output matching section 32 and angle amplifier 34, as shown by ray 40.

If a voltage is applied to either a third or fourth terminal 48, 49 which are connected to third or fourth sections 33, 31, respectively, then the index of refraction of the electrooptical material in the section to which the voltage is applied changes. In this case, the indices of refraction of the third and fourth sections 33, 31 are not equal. As a result, the electromagnetic wave traveling through the electrooptic deflector 30 is refracted at the interface between the third and fourth sections 33, 31 and can travel paths depicted by rays 42-45, depending on the setting of the voltage, for example. The collimated beam 58 illustrates an electromagnetic wave refracted along ray path 42.

Assuming that the angle of deviation is small from the refraction in the electrooptical deflector 30, such angle will be amplified as the electromagnetic wave travels through angle amplifier 34.

Figure 5:
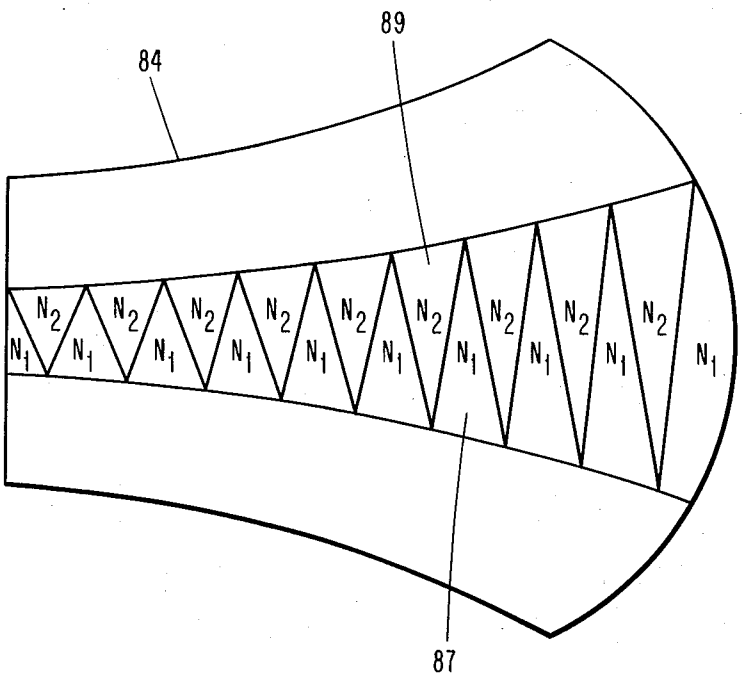
FIG. 5 is a block diagrammatic view of another embodiment of an electrooptic deflector according to the present invention.

An alternative embodiment of an electrooptic deflector is shown in FIG. 5. Electrooptic deflector 84 comprises two parallel plates having therein electrooptic material. In this preferred embodiment of electrooptic deflector 84 the electrooptical material is portioned into sets of triangular elements of electrooptical material. The first set 87 has index of refraction $n_1$ and the second set 89 has index of refraction $n_2$. A voltage is applied to each set. Accordingly, the indices of refraction of the electrooptic material of each set 87, 89 varies in response to a change in voltage applied to the first and second sets 87, 89. As a result, the index of refraction of the electrooptic deflector 84 can vary in a transverse direction.

The transversally varying index of refraction in electrooptic deflector 84 can cause an electromagnetic wave travelling through the electrooptic deflector 84 to deviate. This deviation is in response to the electromagnetic wave being increasingly refracted at each interface between each triangular element of the first and second sets 87, 89 of electrooptical material.

The present invention has the advantage of using a parallel plate waveguide structure which permits a collimated electromagnetic wave, or beam, to be formed and controlled horizontally as it would be in free space, TEM mode. This structure requires, on the other hand, only a limited amount of electrooptic and impedance matching materials.

Additionally, the use of only general properties of the dielectric and electrooptic materials, which are usually only slightly frequency dependent, and the TEM mode in a parallel plate structure ensures that the antenna is broadband. Also, the use of polycrystalline materials in ceramic form makes possible the use of the antenna in high-power applications.

It will be apparent to those skilled in the art that various modifications can be made to the electronically steerable antenna of the instant invention without departing from the scope or spirit of the invention, and it is intended that the present invention cover modifications and variations of the system provided they come within the scope of the appended claims and their equivalents.

What is claimed is:

1. An electronically steerable antenna comprising:

an input matching section having at least two input matching portions tapered in the longitudinal direction for providing a broad band matching characteristic, wherein the second matching portion is shorter than the first matching portion by a ratio set by the index of refraction;

an electrooptic deflector for refracting an electromagnetic wave coupled to said input matching section; and an output matching section having at least two output matching portions tapered in the longitudinal direction for providing a broad band matching characteristic, wherein the second matching portion is shorter than the first matching portion by a ratio set by the index of refraction, coupled to said electrooptic deflector.

2. The electronically steerable antenna as set forth in claim 1 wherein said electrooptic deflector comprises first and second sections including electrooptical material having first and second indices of refraction, respectively.

3. The electronically steerable antenna as set forth in claim 2 further comprising means for applying a voltage to said first or second section, said electrooptical material of said first or second section being responsive to said voltage by varying the first or second index of refraction, respectively.

4. The electronically steerable antenna as set forth in claim 3 wherein said electrooptical material has an index of refraction greater than ten.

5. The electronically steerable antenna as set forth in claim 4 wherein said electrooptical material includes strontium titanate.

6. The electronically steerable antenna as set forth in claim 4 wherein said electrooptical material includes barium strontium titanate.

7. The electronically steerable antenna as set forth in claim 1 further comprising an angle amplifier connected to the output of said output matching section for amplifying the angle of refraction of the electromagnetic wave refracted by said electrooptic deflector.

8. The electronically steerable antenna as set forth in claim 7 wherein said electrooptic deflector comprises first and second sections including electrooptical material having first and second indices of refraction, respectively.

9. The electronically steerable antenna as set forth in claim 8 further comprising means for applying a voltage to said first or second section, said electrooptical material of said first or second section being responsive to said voltage by varying the first or second index of refraction, respectively.

10. The electronically steerable antenna as set forth in claim 9 wherein said electrooptical material has an index of refraction between one and four.

11. The electronically steerable antenna as set forth in claim 9 wherein said angle amplifier includes nonhomogeneous material with an index of refraction varying continuously in a prescribed way for amplifying the angle of refraction of the electromagnetic wave refracted between said first and second sections.

12. An electronically steerable antenna connected to a waveguide and to means for applying a voltage, comprising:

first and second parallel plates connected to said waveguide;

electrooptic means located between said first and second parallel plates, said electrooptic means including first and second sections of electrooptic material having first and second indices of refraction, respectively, said first section connected to said voltage applying means and responsive to changes in the voltage by changing the index of refraction of said first section, for refracting an electromagnetic wave traveling from said first section to said second section;

input matching means located between said first and second parallel plates, said input matching means having at least two input impedance matching portions tapered in the longitudinal direction for providing a broad band matching characteristic, wherein the second matching portion is shorter than the first matching portion by a ratio set by the index of refraction, and connected to said waveguide and to said electrooptic means for coupling the electromagnetic wave travelling from said waveguide to said electrooptic means; and output matching means located between said first and second parallel plates, said output matching means having at least two output impedance matching portions tapered in the longitudinal direction for providing a broad band matching characteristic, wherein the second matching portion is shorter than the first matching portion by a ratio set by the index of refraction, and connected to said electrooptic means for coupling the electromagnetic wave travelling from said electrooptic means to free space.

13. The electronically steerable antenna as set forth in claim 12 wherein said electrooptic material has an index of refraction of at least ten.

14. The electronically steerable antenna as set forth in claim 12 wherein said imput impedance matching portion includes a uniform transition of a dielectric material from air to a solid dielectric material.

15. The electronically steerable antenna as set forth in claim 12 further including means for collimating the electromagnetic wave traveling from said waveguide to said input matching means.

16. The electronically steerable antenna as set forth in claim 15 wherein said collimating means comprises:

a laterally flared horn connected to said waveguide; and a corrective lens connected between said laterally flared horn said input matching means.

17. An electronically steerable antenna connected to a waveguide and to means for applying a voltage, comprising:

first and second parallel plates connected to said waveguide;

electrooptic means located between said first and second parallel plates, said electrooptic means including first and second sections of electrooptical material having first and second indices of refraction, respectively, said first section connected to said voltage applying means and responsive to changes in the voltage by changing the index of refraction of said first section, for refracting an electromagnetic wave traveling from said first section to said second section;

input matching means located between said first and second parallel plates, said input matching means having at least one input impedance matching portion connected to said waveguide and to said electrooptic means for coupling the electromagnetic wave travelling from said waveguide to said electrooptic means;

amplifying means coupled to said electrooptic means having nonhomogeneous material with an index of refraction varying continuously for amplifying the angle of refraction of the electromagnetic wave refracted between said first and second sections; and output matching means located between said first and second parallel plates, said output matching means having at least one output impedance matching portion connected between said electrooptic means and said amplifying means for coupling the electromagnetic wave traveling from said electrooptic means to said amplifying means.

18. The electronically steerable antenna as set forth in claim 17 wherein said electrooptical material has an index of refraction between one and four.

19. The electronically steerable antenna as set forth in claim 17 wherein said input impedance matching portion includes a uniform transition of a dielectric material from air inside said waveguide to a solid dielectric between said first and second parallel plates.

20. The electronically steerable antenna as set forth in claim 17 further including means for collimating the electromagnetic wave traveling from said waveguide to said input matching means.

21. The electronically steerable antenna as set forth in claim 20 wherein said collimating means comprises:

a laterally flared horn connected to said waveguide; and a corrective lens connected between said laterally flared horn and said input matching means.

22. An electronically steerable antenna connected to a waveguide and to means for applying a voltage, comprising:

first and second parallel plates connected to said waveguide;

electrooptic means located between said first and second parallel plates, said electrooptic means having first and second sets of elements of electrooptical material, said first and second sets being connected to said voltage applying means and responsive to changes in the voltage by changing the indices of refraction of said first and second sets, respectively, for refracting an electromagnetic wave travelling through the interfaces between the elements of said first and second sets;

input matching means located between said first and second parallel plates, said input matching means having at least one input impedance matching portion connected to said waveguide and to said electrooptic means for coupling the electromagnetic wave travelling from said waveguide to said electrooptic means; and output matching means located between said first and second parallel plates, said output matching means having at least one output impedance matching portion connected to said electrooptic means for coupling the electromagnetic wave travelling from said electrooptic means to free space.

* * * * *